US006302025B1

(12) United States Patent
Adimari et al.

(10) Patent No.: US 6,302,025 B1
(45) Date of Patent: Oct. 16, 2001

(54) SELF DESTRUCT FUZE WITH IMPROVED SLIDE ASSEMBLY

(75) Inventors: Louis J. Adimari, Montague, NJ (US); Keith R. Fulton, Stroudsburg, PA (US); Joseph A. Donini, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/550,620

(22) Filed: Apr. 17, 2000

(51) Int. Cl.[7] ..... F42C 15/34
(52) U.S. Cl. ..... 102/254
(58) Field of Search ..... 102/259, 226, 102/254

(56) References Cited

U.S. PATENT DOCUMENTS

| | | | | |
|---|---|---|---|---|
| 3,636,878 | * | 1/1972 | Fay | 102/487 |
| 3,768,407 | * | 10/1973 | Savarese, Jr. | 102/424 |
| 4,662,278 | * | 5/1987 | Lillios | 102/223 |
| 5,022,325 | * | 6/1991 | Skowasch et al. | 102/226 |
| 5,048,419 | * | 9/1991 | Skowasch | 102/226 |
| 5,387,257 | * | 2/1995 | Tari et al. | 102/226 |

* cited by examiner

*Primary Examiner*—Charles T. Jordan
*Assistant Examiner*—Jordan M Lofdahl
(74) *Attorney, Agent, or Firm*—John F. Moran; Michael C. Sachs

(57) ABSTRACT

A secondary self-destruct fuze that functions in the event the primary fuze mode fails to function, and that meets the design requirements for a low cost, highly producible no-spin/low velocity operating environment. The fuze includes an improved slide assembly comprised of an aerodynamic safety release (ASR), a safety pin, a secondary firing pin fitted with a spring, a secondary detonator which is placed in alignment with the secondary firing pin, a slide, an omni directional weight release that operates at various impact angles, and a weight release support. In use, the fuze is fitted to a munition or grenade. As the grenade is dispensed from its carrier, the oscillation of a grenade stabilizer causes an arming screw to back out from the fuze slide, allowing the slide assembly to move to an in-line position relative to the center of the fuze. Concurrently, the aerodynamic safety release is lifted in the upward direction under the force of the airstream, releasing the safety pin. This releases the weight release support, which slides out of the fuze. Upon impact with ground, the omni directional weight release drops in a corresponding cavity in the slide, freeing the secondary firing pin, which then impacts the secondary detonator initiating it, which, in turn, initiates a main detonator. If for any reason the primary mode fails to function the grenade, the grenade is rendered safe to handle by the secondary mode that sterilizes a main detonator of the fuze.

13 Claims, 8 Drawing Sheets

SELF DESTRUCT FUZE WITH IMPROVED SLIDE ASSEMBLY

FIELD OF THE INVENTION

The present invention relates to the field of munitions, and more particularly to an improved design for a secondary self-destruct fuze that functions in the event the primary fuze mode fails to function, and that meets the design requirements for a low cost, highly producible no-spin/low velocity operating environment.

BACKGROUND OF THE INVENTION

Dual Purpose Improved Conventional Munitions (DPICM) must have either a self-destruct capability or they must show dud rates not to exceed 1 in 500 as an operational requirement. To this end, several engineering studies were undertaken in an attempt to address the low reliability of the conventional M223 mechanical fuze. However, these studies did not change the basic design of the M223 mechanical fuze. Instead, they generally considered modifying the materials and the manufacturing processes to reduce the dud rate problem.

Conventional designs proposed the development of a hybrid electromechanical fuze which is relatively complex with approximately 40 to 50 parts, with a costly production line. In addition, the no-spin/low velocity operational environments of grenades jeopardize the fuze reliability. Several projectiles have unique operational requirements that the current fuze design might not meet readily.

Some of the concerns facing current self-destruct fuze designs are listed below:

(1) The threads between the arming screw and the weight can be overtorqued.

(2) The fuze components may suffer collateral damage during ejection from the carrier.

(3) The fuze may impact the ground at oblique angles and the firing pin might not provide sufficient energy to the detonator.

(4) The fuze may operate poorly in a no-spin/low velocity environment.

Therefore, there is a still unsatisfied need for a fuze which, among other features, solves the no-spin/low velocity environment, significantly reduces the number of components, improves productivity, and increases the operational reliability of the primary arming mode.

Several engineering studies were conducted in the past two decades in an attempt to address the low reliability of existing mechanical fuzes. Although these 'mechanical only' solutions did improve the overall functional reliability of the fuze, there is still room for an improved design that fully addresses the no-spin/low velocity operational environment, and that significantly reduces the dud rate to the present ordnance requirements for self destruct fuzing of grenades.

A design that proposes a secondary self-destruct electrical mode of operation is described in U.S. Pat. No. 5,387,257. While the patented fuze provides an improvement in the relevant field, the activation of this self-destruct mode requires forces that are not available from no-spin/low velocity environment.

SUMMARY OF THE INVENTION

The present invention contemplates an improved design for a secondary self-destruct fuze that functions in the event the primary fuze mode fails to function, and that meets the design requirements for a low cost, highly producible no-spin/low velocity operating environment.

The fuze offers several features and advantages, among which are the following:

(1) It significantly improves the performance of traditional M223 mechanical fuzes by providing a redundant mode of operation, which adds a self-destruct capability and leads to a tactical destruction of the grenade at impact angles greater than 60 degrees (i.e., between 60 to 80 degrees) relative to the vertical, on all types of terrain.

(2) It significantly simplifies conventional designs and the production process. It uses the main firing mode of the M223 fuze, and adds a few components to the M223 fuze, to add a relatively simple secondary mode of operation through a back up independent firing pin. These additional components can be made of readily available materials that are fabricated for example, by means of stamping, die casting, or precision molding techniques.

(3) It solves the functional reliability problems when operating in a no-spin/low spin environment.

(4) It uses a unique low cost mechanical design to provide a high functional reliability, in almost all operating environments. It uses an aerodynamic safety release (ASR) to function the secondary mode feature and to provide self-destruct capability.

(5) Its components and assemblies are made of readily available materials and are fabricated from stampings, die casting and precision molds.

(6) It meets all MIL-STD-1316D standards.

(7) It is compatible with almost all grenade configurations.

(8) It provides a self destruct delay of between 30–45 seconds.

(9) It improves the fuze reliability with soft ground terrain impacts, and mitigates the problem of grenade impact at oblique angles of impact with the ground.

The foregoing and other features and advantages of the present invention are realized by a fuze that includes an improved slide assembly with a minimum number of components. The fuze operates in two modes. In a primary mode, the fuze can function similarly to a conventional M223 fuze. In a secondary, self-destruct mode, the fuze deploys an improved slide assembly. The slide assembly is comprised of an aerodynamic safety release (ASR), a safety pin, a secondary firing pin fitted with a resilient member such as a spring, a secondary detonator which is placed in alignment with the secondary firing pin, a slide, an omni directional weight release that operates at 0 to 80 degrees impact angles, and a weight release support.

In use, the fuze is fitted to a munition or grenade. As the grenade is dispensed from its carrier, a grenade stabilizer starts to oscillate. The oscillation results in an arming screw and an inertial weight to back out from a slide assembly, allowing the slide assembly to move to an in-line position relative to a main M55 detonator in-line with the arming screw (firing pin). Concurrently, the aerodynamic safety release is lifted in the upward direction under the force of the airstream, releasing the safety pin. This releases the weight release support, which slides out of the fuze.

At this stage, the secondary firing pin is held in place in an unarmed position, only by the omni directional weight release, the safety pin having been pulled up by the aerodynamic safety release. Upon impact with the ground, the omni directional weight release drops in a corresponding cavity in the slide, freeing the secondary firing pin, which then impacts the secondary detonator initiating it, which, in turn, initiates a main detonator. If for any reason the primary mode fails to function the grenade, the grenade is rendered safe to handle by the secondary mode that detonates a main detonator of the fuze.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items.

DETAILED DESCRIPTION OF THE INVENTION

Figure 1:
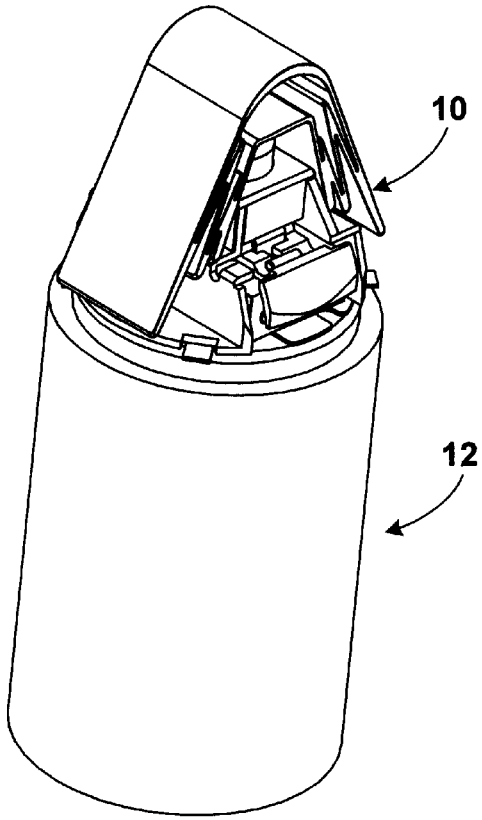
FIG. 1 is a perspective view of a fuze incorporating an improved slide assembly according to the present invention, shown secured to a grenade or munition.
Figure 2:
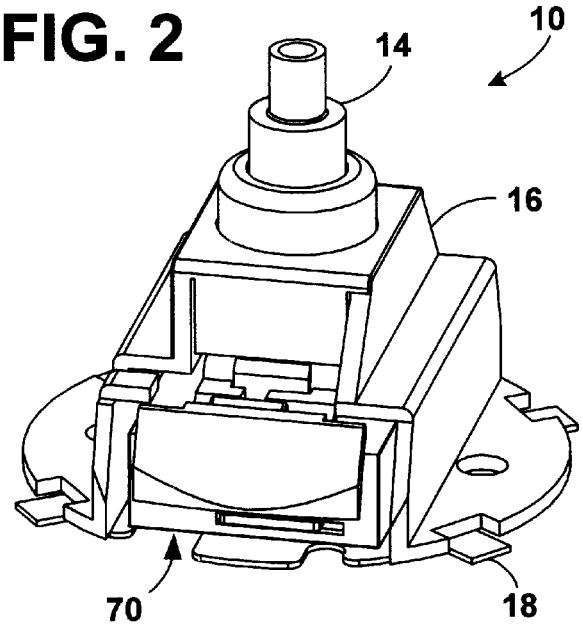
FIG. 2 is an enlarged perspective view of the fuze of FIG. 1.

FIG. 1 illustrates a fuze 10 according to the present invention shown secured to a grenade 12. With reference to FIG. 2, the fuse 10 generally includes an arming screw and weight assembly 14, a housing 16, a cover 18, and a slide assembly 70. In an unarmed condition, the slide assembly 70 is secured to the housing 16 and the cover 18. In an armed condition, the slide assembly 70 moves between the housing 16 and the cover 18.

The fuze 10 operates in two modes: a primary mode and a secondary mode. In the primary mode, the fuze functions similarly to a conventional M223 fuze. The slide assembly 70 is spring-loaded from below, and in a primary mode, when it is released by the fuze safety system and free to move, it places a main detonator 19 (FIG. 3) in line between a main firing pin (combined with the arming screw of the fuze 10), and an opening in the cover 18. This will expose a main charge of the grenade 12 to the action of the main firing pin and the detonator.

Figure 3:
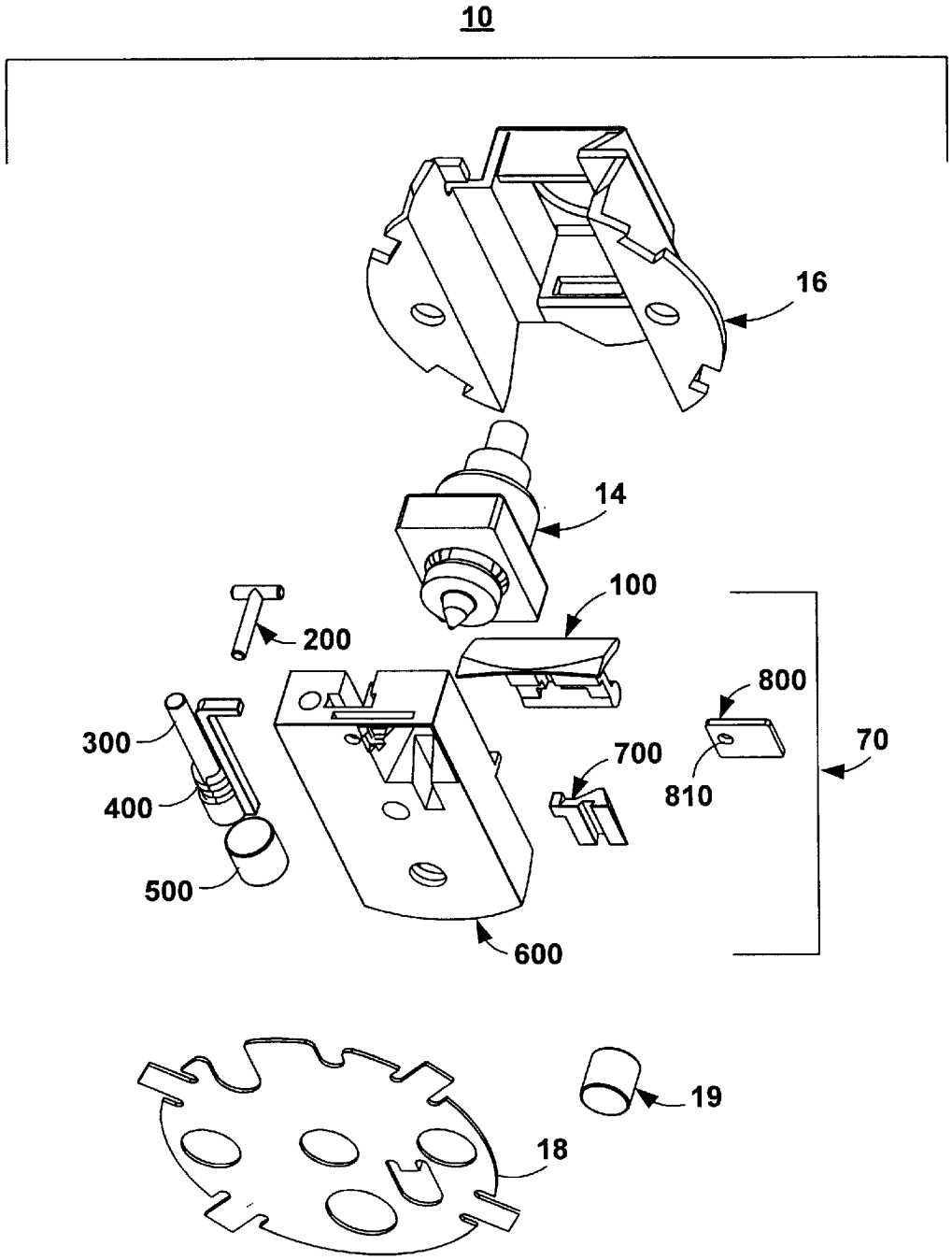
FIG. 3 is an exploded view of the fuze of FIGS.1 and 2.
Figure 4:
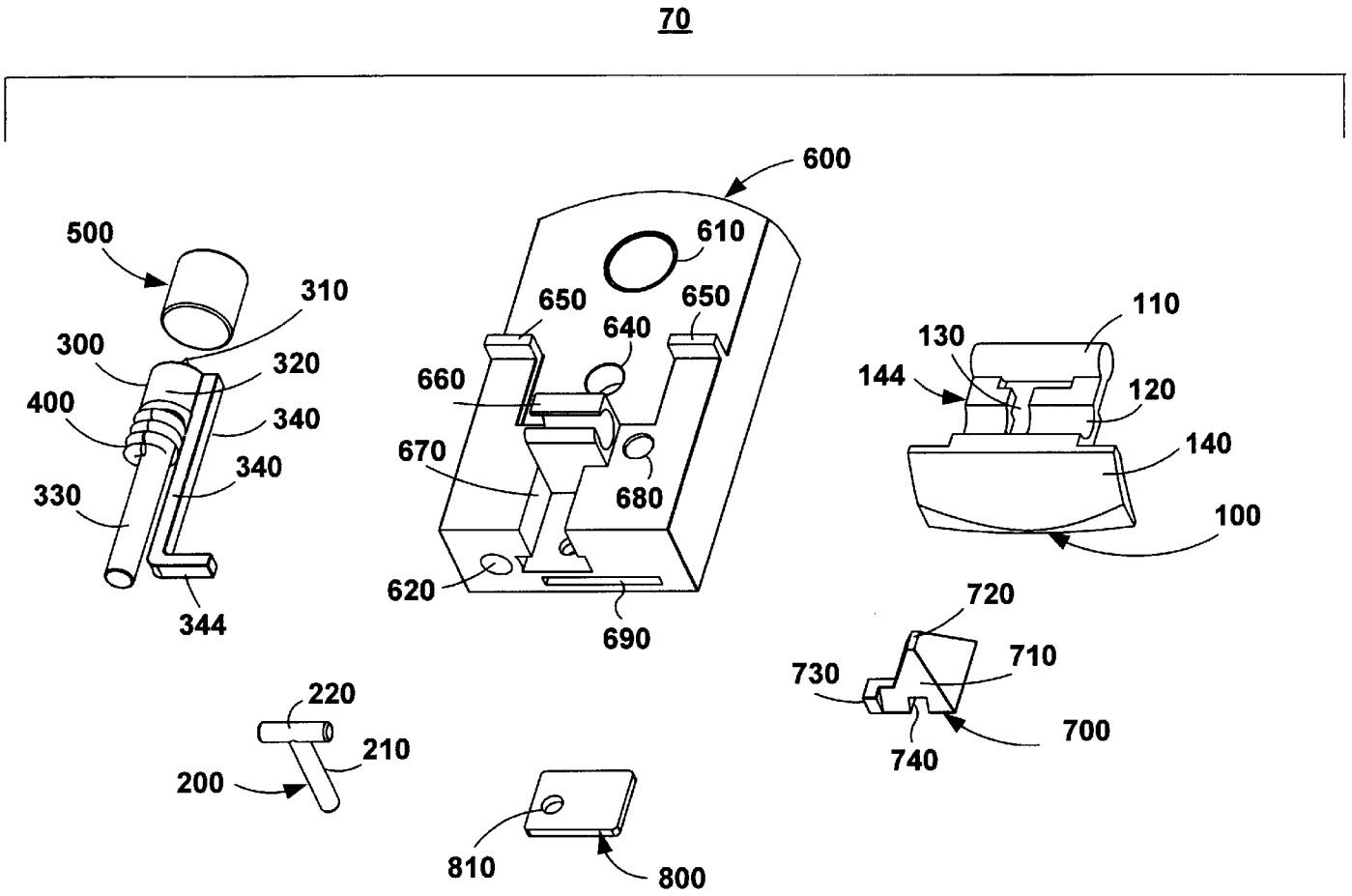
FIG. 4 is a perspective view of the slide assembly of FIGS. 1–3, shown unassembled.
Figure 5:
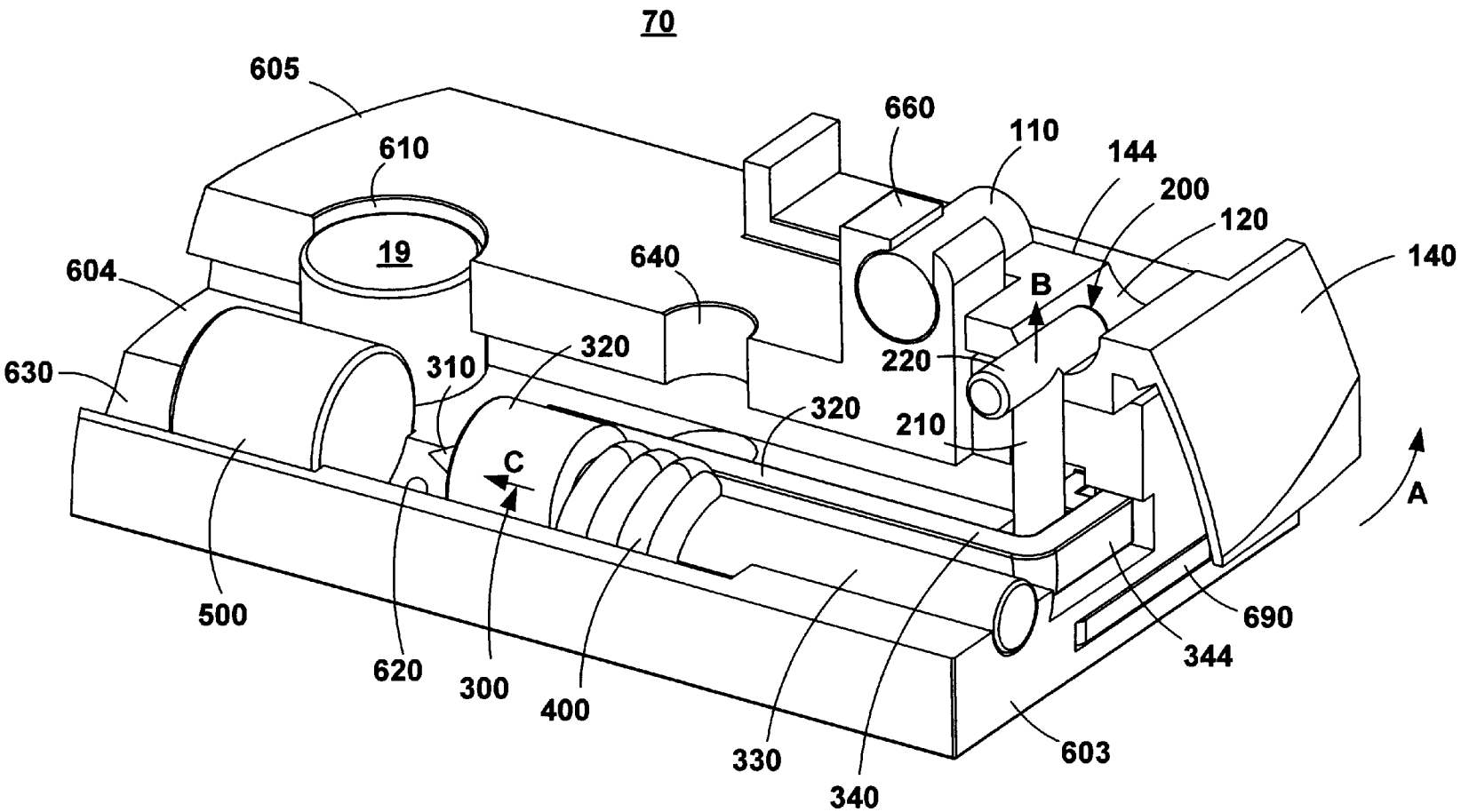
FIG. 5 is a perspective, partly cutaway view of the slide assembly of FIG. 4, shown assembled.
Figure 6:
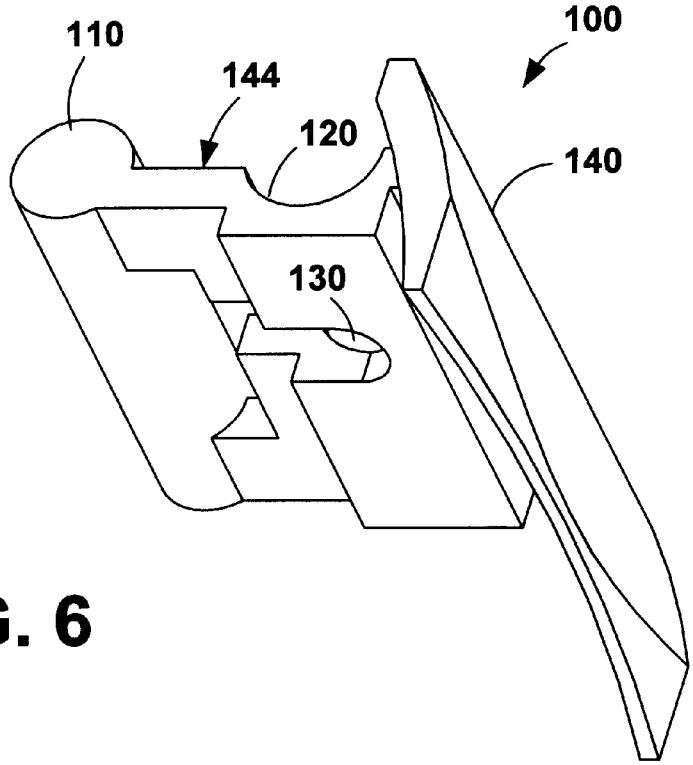
FIG. 6 is an enlarged, perspective, bottom view of an aerodynamic safety release (ASR) forming part of the slide assembly of FIGS. 4 and 5.
Figure 7:
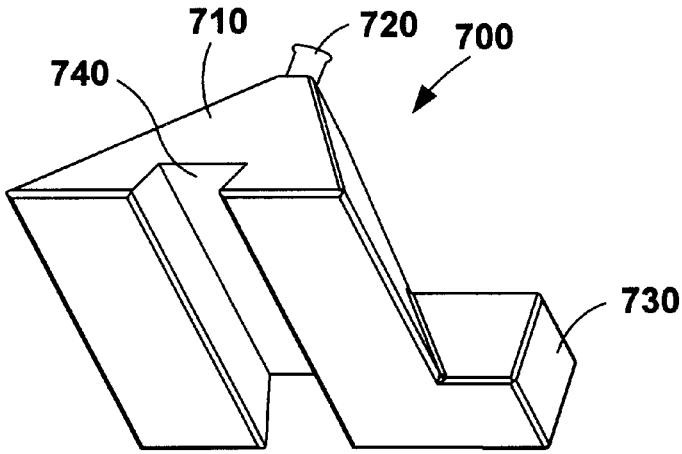
FIG. 7 is an enlarged, perspective, bottom view of an omni directional weight release forming part of the slide assembly of FIGS. 4 and 5.
Figure 8:
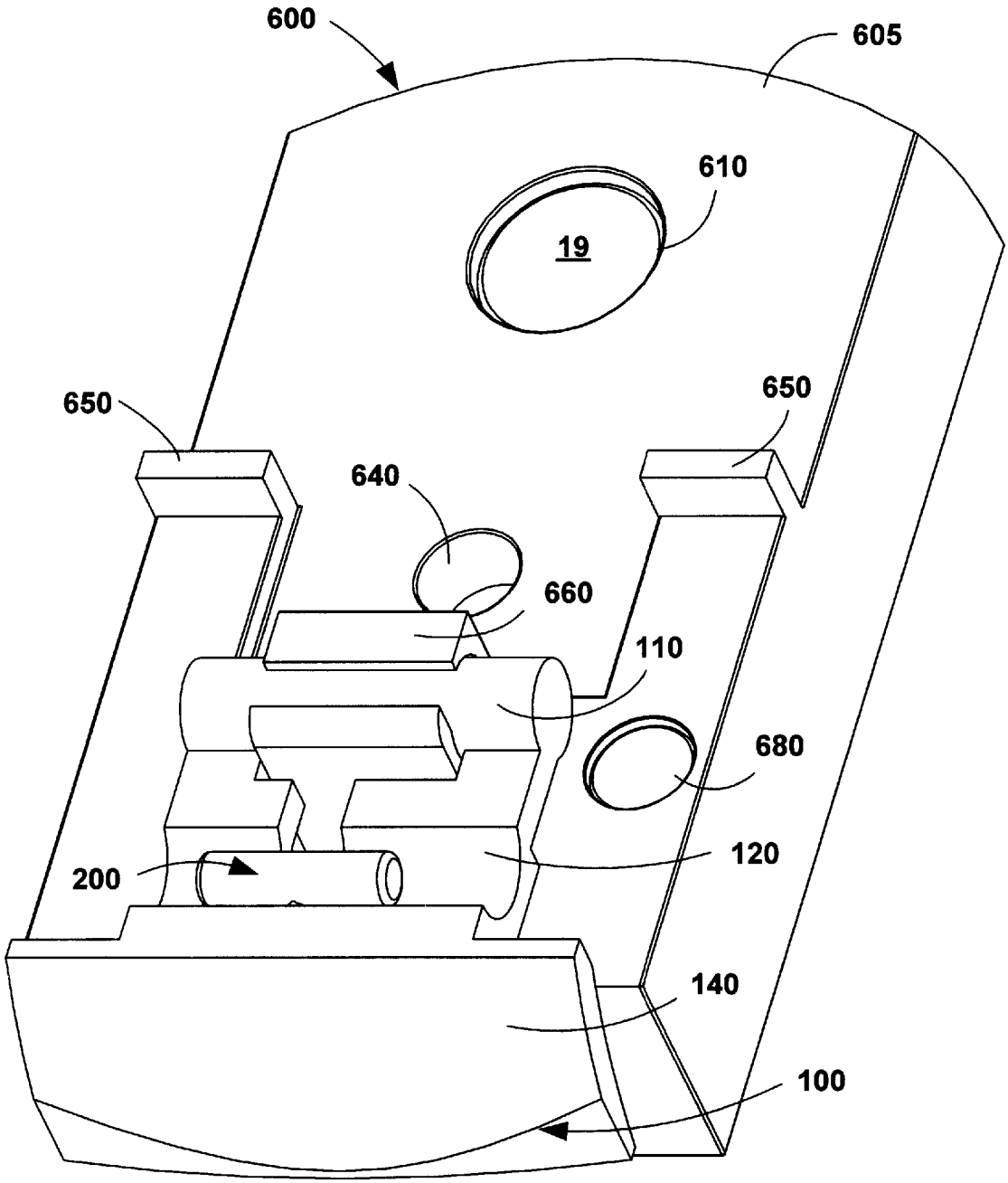
FIG. 8 is a perspective, top view of a slide body forming part of the slide assembly, shown seating the aerodynamic safety release of FIG. 6.
Figure 9:
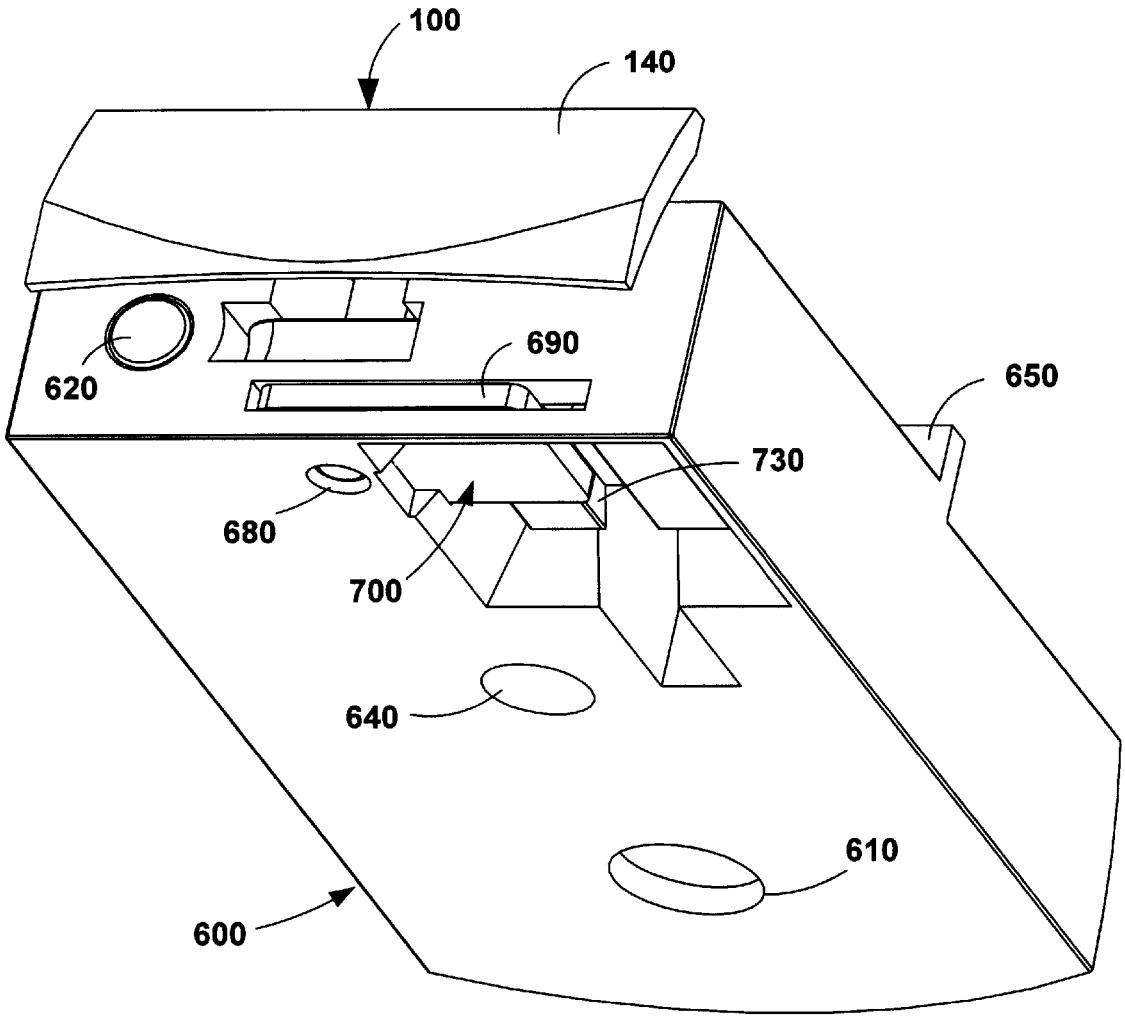
FIG. 9 is a perspective bottom view of the slide body and aerodynamic safety release of FIG. 8.
Figure 10:
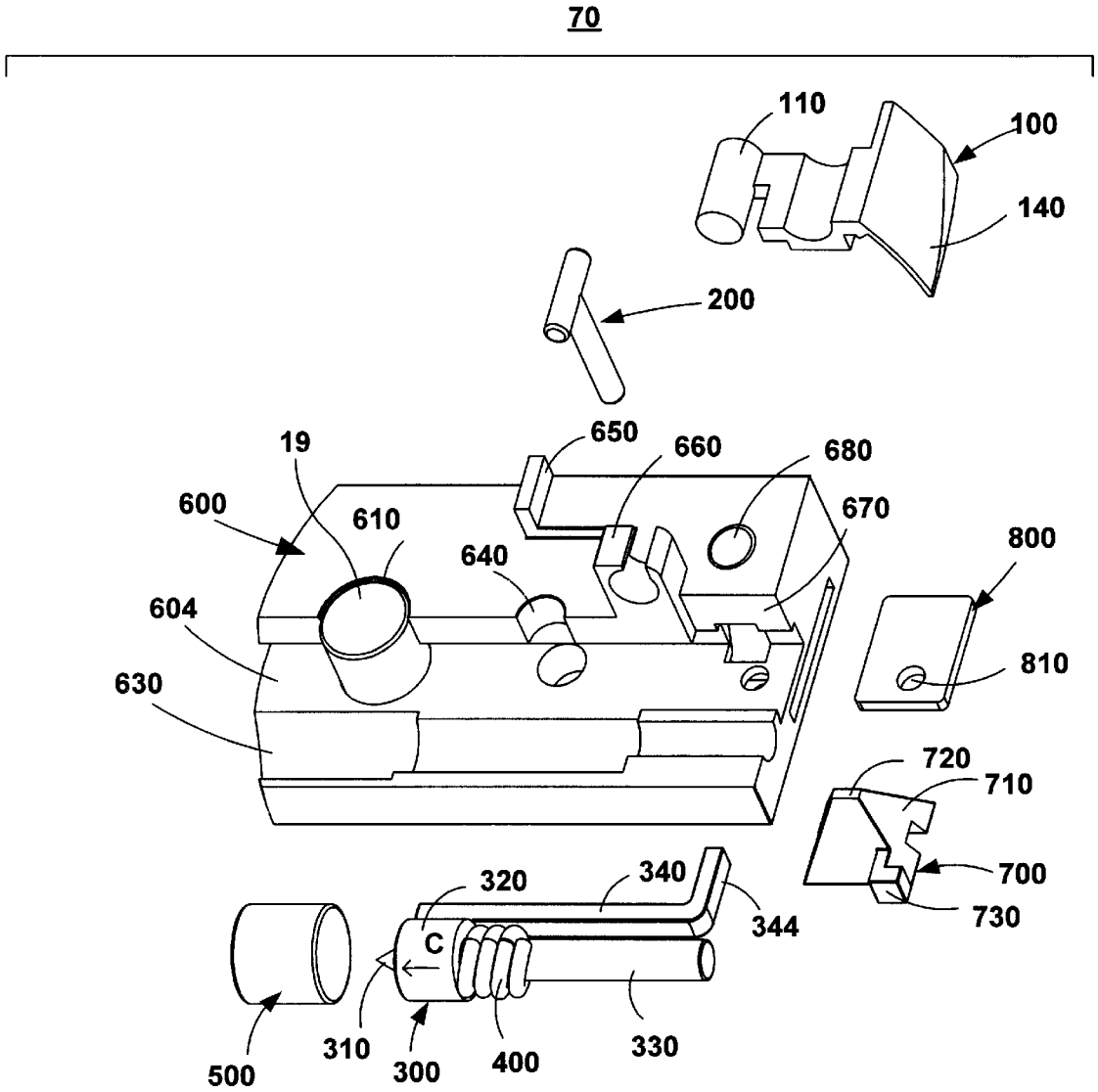
FIG. 10 is a perspective, partly cutaway view of the slide assembly of FIGS. 4 and 5, shown unassembled.

With reference to FIGS. 3 and 4, the slide assembly 70 is comprised of an aerodynamic safety release (ASR) 100, a safety pin 200, a secondary firing pin 300 fitted with a spring 400, a secondary detonator 500 which is placed in alignment with the secondary firing pin 300, a slide 600, an omni directional weight release 700 that operates at 0 to 80 degrees impact angles, and a weight release support 800.

The aerodynamic safety release 100 is preferably made of, for example, polycarbonate, using an injection molding process. The safety pin 200 can be made of metal, using a corrosion resistant steel. The secondary firing pin 300 is made of metal, using a corrosion resistant steel. The spring 400 of the secondary firing pin 300 is formed of resilient material. The secondary detonator 500 is made of known or available material capable of initiating the main detonator 19. The slide 600 is preferably made of polycarbonate, using an injection molding process. The slide 600 includes several features and accommodates the remaining components of the slide assembly 70. The omni directional weight release 700 is made of a corrosion resistant steel or a higher density material, and is designed to function upon impact with ground. Preferably, the weight release 700 has a general pyramidal shape that matches the shape of a pyramidally shaped opening 680 formed in the bottom of the slide 600. The pyramidal shape of the weight release 700 allows it to function at impact angles between for example, 0 to 80 degrees relative to the vertical, on all types of terrain.

The weight release 700 is retained in position, in the unarmed condition, by the weight release support 800. The weight release support 800 is typically a rectangularly shaped plate, made for example of corrosion resistant steel, and formed from a stamping die. The weight release support 800 includes a hole 810 the function of which will be explained below.

In use, the fuze 10 is fitted to a munition such as the grenade 12. As the grenade 12 is dispensed from its carrier (not shown), a grenade stabilizer (not shown) starts to oscillate. This oscillation causes the arming screw and weight assembly 14 to back out from both the housing and the slide assembly, allowing the slide assembly 70 to move to an in-line position relative to the center axis of the grenade and fuze and also in-line with the main detonator of the fuze. Concurrently, the aerodynamic safety release 100 is lifted in the upward direction under the force of the airstream, releasing the safety pin 200. This releases the weight release support 800, which slides out of the fuze 10.

At this stage, the secondary firing pin 300 is held in place in an unarmed position, only by the omni directional weight release 700, the safety pin 200 having been pulled up by the aerodynamic safety release 100. Upon impact with the ground, the omni directional weight release 700 drops in a corresponding cavity in the slide 600, freeing the secondary firing pin 300, which then impacts the secondary detonator initiating it, and which, in turn, initiates the main fuze detonator.

This sequence of operation demonstrates two redundant modes of arming the fuze 10. If the primary mode arming screw does not back out of the weight when the ribbon stabilizer is released in the air stream, there is a high probability that the aerodynamic safety release 100 will arm the independent secondary mode. If the primary mode arms the slide assembly into the in-line position, the arming screw and weight will be driven into the primary detonator upon ground impact, resulting in the detonation of the grenade 12.

If, however, the arming screw does not back out of the weight when falling in the air stream, the omni directional weight release 700 will be driven downward upon ground impact, triggering the secondary self-destruct mode, thus sterilizing the grenade 12 and rendering it safe to handle.

A situation may develop whereby the fuze 11 is armed in the primary mode, and the grenade 12 strikes the ground at an angle of, for example 60 degrees or greater relative to the vertical, such that the arming screw and weight are not driven into the primary detonator. Prior to the advent of the present invention, this situation would have resulted in a possible hazardous dud. However, the aerodynamic safety release 100 of the slide assembly 70 causes the omni directional weight release 700 to trigger the secondary self-destruct mode of operation at impact the above exemplary impact angle. This will minimize, or eliminate hazardous duds at impact angles greater than 60 degrees on almost all types of terrain.

Having described the main components and operation of the fuze 10, the improved slide assembly 70 will now be described in greater detail in connection with FIGS. 3–7.

The slide 600 (FIGS. 4, 5, and 8–10) includes several features and retains the remaining components of the slide assembly 700. The slide 600 includes a generally rectangularly shaped slide body 603 which is defined by a base 604 and an upper surface 605. An upright opening 610 is formed in the slide body 603, and extends through the upper surface 605 to the base, in order to accommodate the main detonator 19 (FIG. 3) and to cause it to be retained against the base 604. The opening 605 is as deep as the height of the detonator 19.

A longitudinal channel 620 is formed in the slide body 603, and allows the secondary firing pin 300 and the spring 400 to be inserted in the slide body 603. Another longitudinal channel 630 (FIG. 5) is coaxially disposed relative to the longitudinal channel 620, and retains the secondary detonator 500 inside the slide body 603. The directional terms used herein, such as "upright", "longitudinal", lateral, and so forth do not imply absolute directions, but rather connote that an angular disposition exists between the related components.

An upright opening 640 extends through the slide body 603, and allows the main firing pin to nest in the slide body 603, and to lock the movement of the slide 600 within the housing 16. Two upright tabs 650 are located on opposite sides of the opening 640, and extend at an angle from and relative to the upper surface 605. The tabs 650 provide a stop to the slide assembly 70 once it has moved into the in-line position with the center axis of the grenade and fuze, by butting against the inner surface of the housing 16.

A pivotal slot 660 is provided to accommodate a cylindrically shaped bracket 110 of the aerodynamic safety release 100 as it will be explained later. A channel 670 allows an upright member 210 of the safety pin 200 to be inserted in, and retained by the slide 600.

A pyramidally shaped opening 680 has its larger base adjacent to the slide base 604, for allowing the omni directional weight release 700 to be inserted into the slide body 603 from below. A narrow longitudinal channel 690 allows the weight release support 800 to be inserted inside the slide body 603, for supporting the omni directional weight release 700.

The aerodynamic safety release 100 (FIGS. 4, 5, 6, 8–10) is designed to catch the airstream after the grenade 12 has been ejected from its carrier, which causes the safety pin 200 to be lifted up from its nested position in the slide 600. The aerodynamic safety release 100 is comprised of the bracket 110 that fits in the pivotal slot 660 of the slide 600, a wing 140, and a connecting member 144 that connects the bracket 110 and the wing 140.

A lateral member 220 of the safety pin 200 rests in and a lateral groove 120 formed in the connecting member 144 of the aerodynamic safety release 100, to ensure proper seating of the safety pin 200 against the aerodynamic safety release 100. A through opening 130 is generally disposed along a central axis of the connecting member 144, and is preferably positioned in registration with the channel 670, so that the upright member 210 of the safety pin 200 can be inserted simultaneously through both the channel 670 and the opening 130.

The wing 140 is slightly curved so that it is folded inward toward the slide 600, so that it is deployed in the direction of the arrow A, when it catches the airstream.

The safety pin 200 is generally T-shaped, and is designed to be inserted in the slide 600, as explained earlier, to limit or prevent the movement of the secondary firing pin 300 relative to the weight release support 800.

The secondary firing pin 300 (FIGS. 4, 5) is generally comprised of a firing pin tip 310, two cylindrical sections 320, 330 that fit and move inside the slide 600, and an L-shaped rod 340 which is secured to one of the cylindrical section 320. The rod 340 is held in the unarmed position by the firing pin 200 and a locking ledge 730 formed in the omni directional weight release 700. When the fuze 10 is in an unarmed condition, the firing pin tip 310 is disposed generally co-axially with, and at a distance from the secondary detonator 500.

When in an armed condition, the secondary firing pin spring 400 provides the necessary force for the secondary firing pin 300 to impact against, and to initiate the secondary detonator 500. The principal function of the secondary detonator 500 is to initiate the adjacently disposed main detonator 19 in the event the primary mode of operation of the fuze 10 fails to function the grenade 12, thus rendering the grenade 12 safe to handle.

The omni directional weight release 700 (FIGS. 4, 7) is designed to function upon ground impact. Its shape is generally pyramidal, which matches the shape of the opening 680 in the bottom of the slide 600. The shape of the omni directional weight release 700 allows it to function at impact angles as low as 80 degrees relative to the vertical on generally all types of terrain, since the primary mode only functions effectively at impact angles as low as 60 degrees.

The omni directional weight release 700 includes a pyramid shaped base 710, a top pin 720 that extends from the base 710, the locking ledge 730, and a bottom channel 740. The pin 720 fits in a cylindrically shaped opening 680 in the slide upper surface 605, and serves to restrict the movement of the weight release 700 to an up or down motion.

The locking ledge 730 protrudes from one side of the base 710, and restrains the movement of the secondary firing pin 300 by latching onto one side 344 of the rod 340. The omni directional weight release 700 is kept in place, in the unarmed condition, by means of the weight release support 800. In turn, the weight release support 800 is maintained in position in the slide 600 by means of the safety pin 200 that extends through the opening 810. The channel 740 can be used for attaching a leaf spring to the underside of the part to ease loading during assembly operations.

It should be understood that the geometry and dimensions of the components described herein may not be to scale, and may be modified within the scope of the invention. The embodiments described herein are included for the purposes of illustration, and are not intended to be the exclusive; rather, they can be modified within the scope of the invention. Other modifications may be made when implementing the invention for a particular application.

What is claimed is:

1. A self-destruct fuze comprising:

a slide assembly including:

an aerodynamic safety release;

a safety pin;

a secondary firing pin, wherein the secondary firing pin is fitted with a resilient member;

a secondary detonator placed in alignment with the secondary firing pin;

a slide; and an omni directional weight release, further including a weight release support.

2. A self-destruct fuze comprising:

a slide assembly including;

an aerodynamic safety release;

a safety pin;

a secondary firing pin;

a secondary detonator placed in alignment with the secondary firing pin;

a slide; and an omni directional weight release, further including a weight release support, wherein the aerodynamic safety release is lifted in from a first position in an unarmed condition, under the force of an airstream, to release the safety pin;

wherein the release of the safety pin releases the weight release support, which disconnects from the fuze, and whereupon the secondary firing pin remains held in place in an unarmed position by the omni directional weight release.

3. The self-destruct fuze according to claim 2, wherein upon impact, the omni directional weight release drops in a cavity in the slide to free the secondary firing pin, and whereupon, the omni directional weight release impacts and initiates the secondary detonator, which, in turn, initiates a main detonator.

4. A self-destruct fuze comprising:

a slide assembly including:

an aerodynamic safety release;

a safety pin;

a secondary firing pin;

a secondary detonator placed in alignment with the secondary firing pin;

a slide; and an omni directional weight release, further including a weight release support, further including an arming screw and weight assembly, further including a housing and a cover;

wherein in an unarmed condition, the slide assembly is secured to the housing and the cover; and wherein in an armed condition, the slide assembly moves between the housing and the cover.

5. The self-destruct fuze according to claim 4, wherein the slide assembly is spring-loaded, and wherein in a primary mode, the slide assembly places a main detonator in line between a main firing pin and an opening in the cover, exposing a main lead charge to the action of the main firing pin and the detonator.

6. A self-destruct fuze comprising:

a slide assembly including:

an aerodynamic safety release;

a safety pin;

a secondary firing pin;

a secondary detonator placed in alignment with the secondary firing pin;

a slide; and an omni directional weight release, further including a weight release support, wherein the weight release has a generally pyramidal shape.

7. The self-destruct fuze according to claim 6, wherein the weight release support includes a generally rectangularly shaped plate.

8. The self-destruct fuze according to claim 1, wherein the slide includes a slide body which is defined by a base and an upper surface; and wherein an opening is formed in the slide body, and extends through the upper surface to the base, to accommodate a main detonator and to cause the main detonator to be retained against the base.

9. The self-destruct fuze according to claim 8, wherein the slide body includes a channel that allows the secondary firing pin and the resilient member to be inserted in the slide body.

10. The self-destruct fuze according to claim 9, wherein the slide body includes a pivotal slot; and wherein the aerodynamic safety release includes a bracket that fits in the pivotal slot, a wing, and a connecting member that connects the bracket and the wing.

11. The self-destruct fuze according to claim 1, wherein the secondary firing pin includes a firing pin tip, two generally cylindrically shaped sections that fit and move inside the slide, and a generally L-shaped rod which is secured to one of the cylindrically shaped sections.

12. The self-destruct fuze according to claim 11, wherein the rod is held in an unarmed position by the firing pin and a locking ledge formed in the omni directional weight release; and wherein when the fuze is in an unarmed condition, the firing pin tip is disposed generally co-axially with, and at a distance from the secondary detonator.

13. The self-destruct fuze according to claim 12, wherein, when the fuze in an armed condition, the resilient member provides a force that causes the secondary firing pin to impact against, and to initiate the secondary detonator.

* * * * *